US009382919B2

(12) United States Patent
Cheng et al.

(10) Patent No.: US 9,382,919 B2
(45) Date of Patent: Jul. 5, 2016

(54) FAN BLADE STRUCTURE

(71) Applicants: Inventec (Pudong) Technology Corporation, Shanghai (CN); INVENTEC CORPORATION, Taipei (TW)

(72) Inventors: Yi-Lun Cheng, Taipei (TW); Wei-Yi Lin, Taipei (TW); Chun-Lung Lin, Taipei (TW); Chih-Kai Yang, Taipei (TW)

(73) Assignees: INVENTEC (PUDONG) TECHNOLOGY CORPORATION, Shanghai (CN); Inventec Corporation, Taipei (TW)

( * ) Notice: Subject to any disclaimer, the term of this patent is extended or adjusted under 35 U.S.C. 154(b) by 614 days.

(21) Appl. No.: 13/846,395

(22) Filed: Mar. 18, 2013

(65) Prior Publication Data

US 2014/0127022 A1 May 8, 2014

(30) Foreign Application Priority Data

Nov. 8, 2012 (CN) ..... 2012 1 0444465

(51) Int. Cl.
*F04D 29/00* (2006.01)
*F04D 29/28* (2006.01)
*F04D 29/66* (2006.01)

(52) U.S. Cl.
CPC ..... *F04D 29/666* (2013.01); *F04D 29/281* (2013.01)

(58) Field of Classification Search
CPC ..... F04D 29/281; F04D 29/666
USPC ..... 416/183, 192, 185, 198 R, 97 R, 220 R
See application file for complete search history.

(56) References Cited

U.S. PATENT DOCUMENTS

2012/0251323 A1* 10/2012 Chiu ..... F01D 5/02 416/198 R
2012/0321495 A1* 12/2012 Duke ..... F04D 29/666 417/423.7

* cited by examiner

*Primary Examiner* — Jesse Bogue
*Assistant Examiner* — Dapinder Singh
(74) *Attorney, Agent, or Firm* — Locke Lord LLP; Tim Tingkang Xia, Esq.

(57) ABSTRACT

A fan blade structure includes a hub, an annular partition surrounding the hub, a first blade group and a second blade group. The hub has a top surface and a flank connected to the top surface. The first blade group, disposed on one side of the annular partition, includes two blade arrays having multiple first and second blades respectively. The clearance between the two adjacent first blades is less than that between the two adjacent second blades. The second blade group, disposed on another side of the annular partition, includes another two blade arrays having a plurality of third and fourth blades respectively. The clearance between the two adjacent third blades is less than that between the two fourth blades adjacent to each other.

9 Claims, 12 Drawing Sheets

FAN BLADE STRUCTURE

CROSS-REFERENCE TO RELATED APPLICATIONS

This non-provisional application claims priority under 35 U.S.C. §119(a) on Patent Application No(s). 201210444465.7 filed in China, P.R.C. on Nov. 8, 2012, the entire contents of which are hereby incorporated by reference.

BACKGROUND OF THE INVENTION

1. Technical Field of the Invention

The disclosure relates to a heat-dissipation device, and more particular to a fan blade structure.

2. Description of the Related Art

The development of electronic technology has enhanced the performance of electronic components. However, heat produced by electronic components is generally increased as the performance advancing. Such heat accumulated in the electronic components results in temperature rise thereof. When the heat cannot be dissipated effectively from the components to cool down, the electronic components may break down or even burn out. Therefore, generally electronic devices are provided with heat dissipation devices to dissipate heat generated by the electronic components.

Generally speaking, water-cooled heat dissipation devices and air-cooled heat dissipation devices are used for dissipating the heat generated by the electronic components. The water-cooled heat dissipation device removes heat by a heat exchange between the cooling fluid in a cooling pipe driven by a compressor or a pump therein and the electronic device. The air-cooled heat dissipation device removes heat by using fan to guide cold air through the electronic device for heat exchange. Compared with the water-cooled type, the air-cooled type does not require a compressor, a pump and a cooling fluid, having a cost advantage. Therefore, the air-cooled type is widely used for heat dissipation in the industry.

However, the air-cooled heat dissipation device has an improved efficiency, while a high noise incurred. Specifically, when the rotational speed of the fan is increased, a higher efficiency of heat dissipation is achieved. Nonetheless, it may also cause a higher decibel noise, thereby affecting quality of life. Thus, now noise reduction for the air-cooled heat dissipation device is one of the main problems to be solved by designers.

SUMMARY OF THE INVENTION

One embodiment of the disclosure provides a fan blade structure comprising a hub, an annular partition, a first blade group and a second blade group. The hub has a top surface and a flank. The flank is connected to the top surface. The annular partition surrounds the hub. The first blade group is disposed on one side of the annular partition, and comprises a first blade array and a second blade array that are disposed on the flank together. The first blade array comprises a plurality of first blades, and the second blade array comprises a plurality of second blades. The clearance between the two first blades adjacent to each other is less than that between the two second blades adjacent to each other. The second blade group is disposed on another side of the annular partition, and comprises a third blade array and a fourth blade array that are disposed on the flank together. The third blade array comprises a plurality of third blades. The fourth blade array comprises a plurality of fourth blades. The clearance between the two third blades adjacent to each other is less than that between the two fourth blades adjacent to each other.

Another embodiment of the disclosure provides a fan blade structure comprising a hub, an annular partition, a first blade group and a second blade group. The hub has a top surface and a flank. The flank is connected to the top surface. The annular partition is located on the flank. The first blade group is disposed on one side of the annular partition, and comprises a plurality of first blades and a plurality of second blades. The plurality of first blades and the plurality of second blades are arranged in a staggered form. The plurality of first blades and the plurality of second blades respectively have a connection segment and a free segment connected. The connection segments of the plurality of first blades and the plurality of second blades are connected to the annular partition respectively. The connection segment and the free segment of each first blade form a first angle. The connection segment and the free segment of each second blade form a second angle. The second angle is different from the first angle. The second blade group is disposed on another side of the annular partition, and comprises a plurality of third blades and a plurality of fourth blades. The plurality of third blades and the plurality of fourth blades are arranged in a staggered form. The plurality of third blades and the plurality of fourth blades respectively have a connection segment and a free segment connected. The connection segments are respectively connected to the annular partition. The connection segment and the free segment of each third blade form a third angle. The connection segment and the free segment of each fourth blade form a fourth angle. The fourth angle is different from the third angle.

Still another embodiment of the disclosure provides a fan blade structure comprising a hub, an annular partition, a first blade group and a second blade group. The hub has a top surface and a flank. The flank is connected to the top surface. The annular partition is located on the flank. The first blade group is disposed on one side of the annular partition, and comprises a plurality of first blades, a plurality of second blades and a plurality of third blades. The plurality of first blades, the plurality of second blades and the plurality of third blades are arranged in a first order, and altogether surround the hub. The plurality of first blades, the plurality of second blades and the plurality of third blades respectively have a connection segment and a free segment connected to each other. The connection segments of the plurality of first blades, the plurality of second blades and the plurality of third blades are connected to the annular partition respectively. The connection segment and the free segment of each of the plurality of first blades form a first angle. The connection segment and the free segment of each of the plurality of second blades form a second angle. The connection segment and the free segment of each of the plurality of third blades form a third angle. The first angle, second angle and third angle are different from each other. The second blade group is disposed on another side of the annular partition. The second blade group comprises a plurality of fourth blades, a plurality of fifth blades and a plurality of sixth blades that are all arranged in a second order. The plurality of fourth blades, the plurality of fifth blades and the plurality of sixth blades respectively have a connection segment and a free segment connected to each other. The connection segments of them are connected to the annular partition respectively. The connection segment and the free segment of each of the plurality of fourth blades form a fourth angle. The connection segment and the free segment of each of the plurality of fifth blades form a fifth angle. The connection segment and the free segment of each of the plurality of sixth blades form a sixth angle. The fourth angle, the fifth angle and the sixth angle are different from each other.

DETAILED DESCRIPTION

Figure 1:
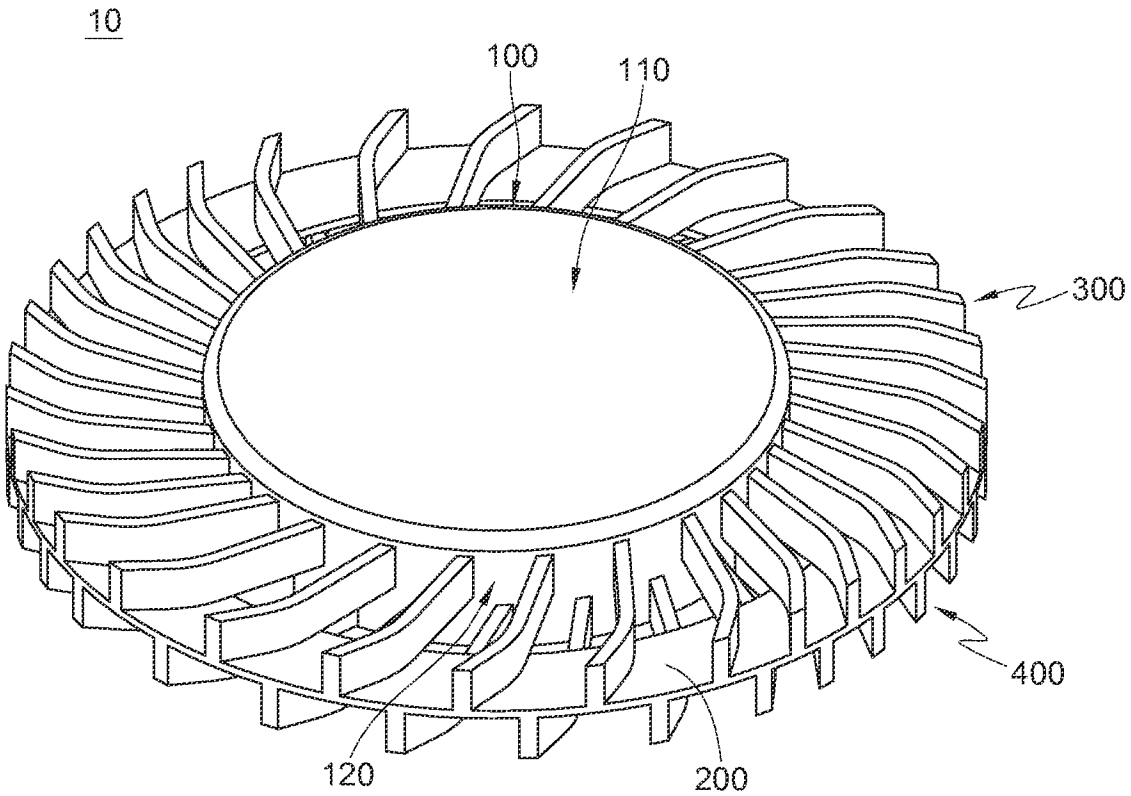
FIG. 1 is a perspective view of a fan blade structure disclosed in a first embodiment.
Figure 2A:
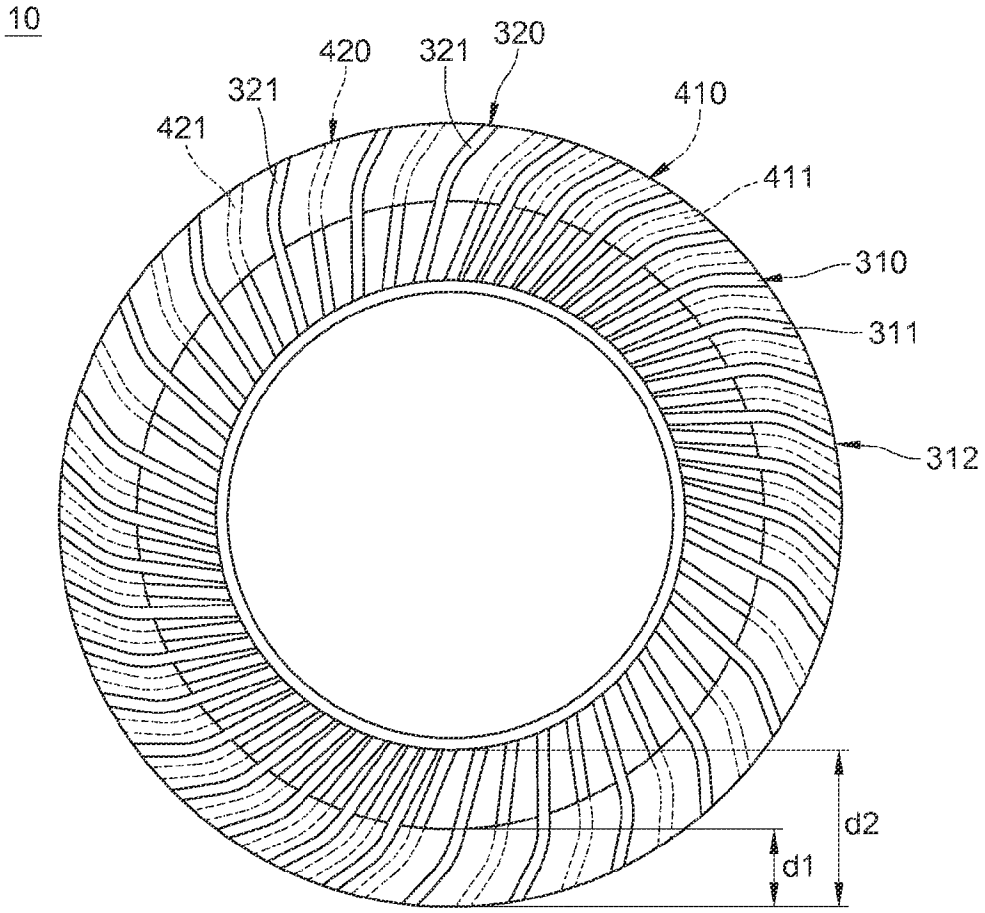
FIG. 2A is a plan view of FIG. 1.
Figure 2B:
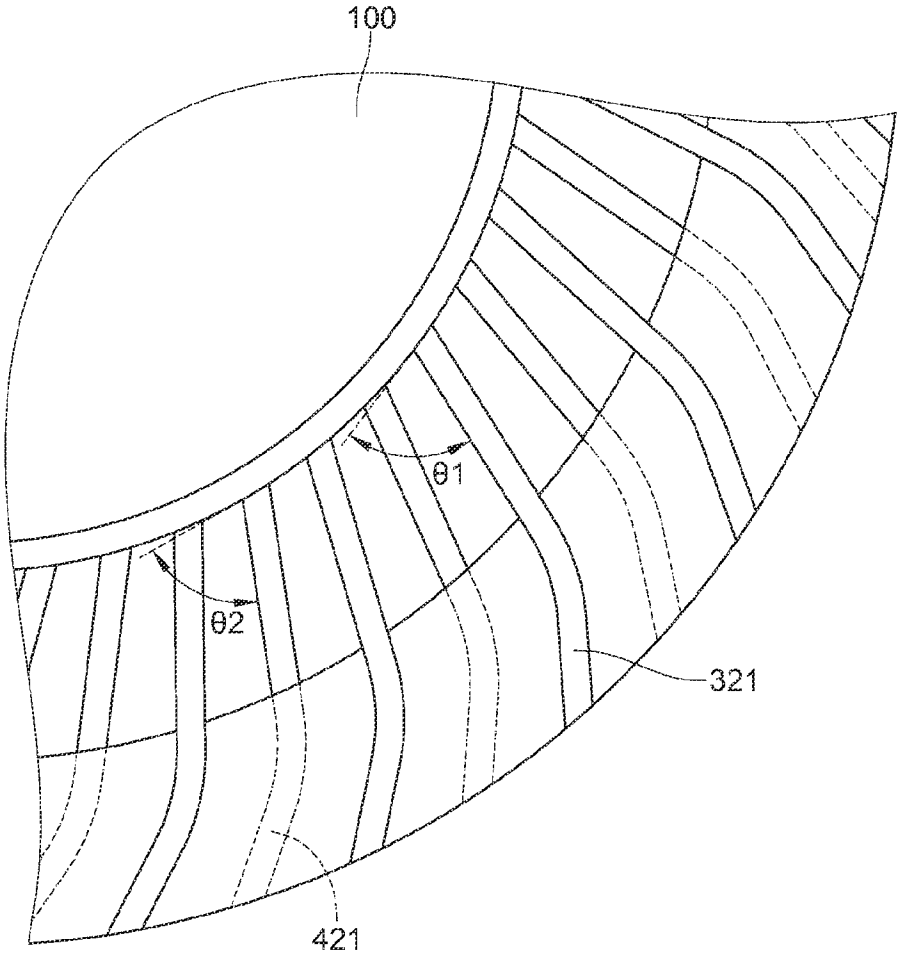
FIG. 2B is an enlarged view of FIG. 2A.
Figure 2C:
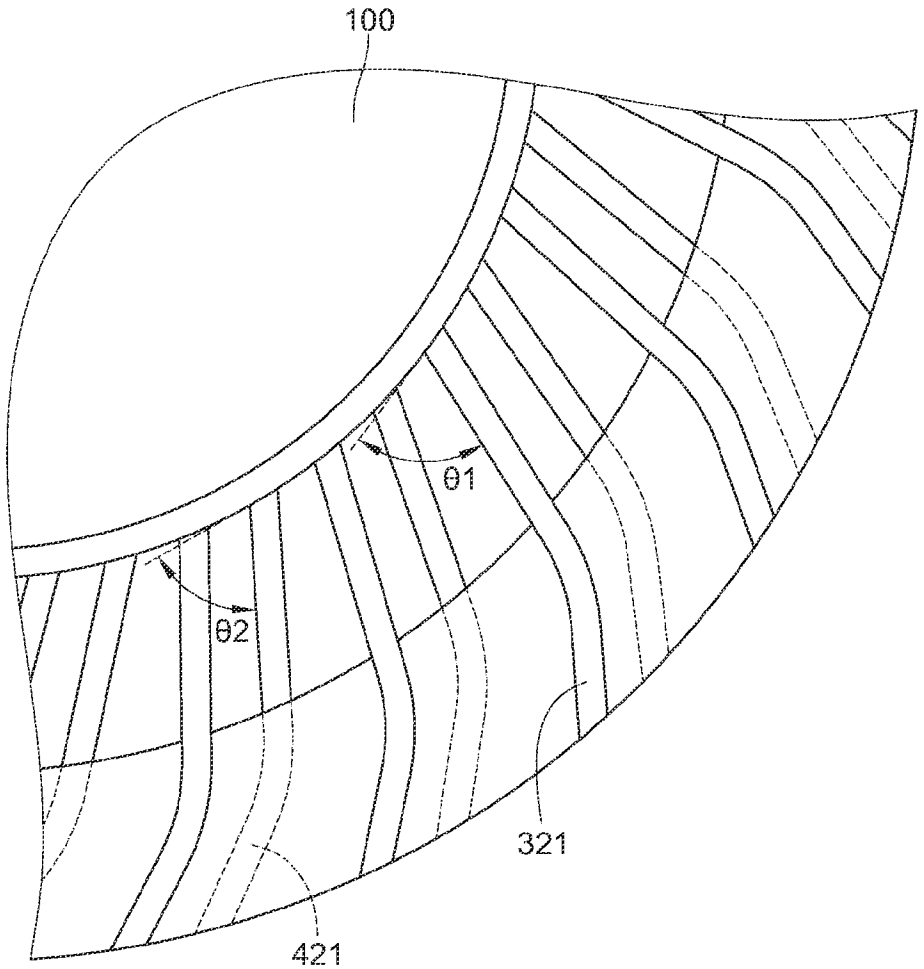
FIG. 2C is a plan view of a fan blade structure disclosed in a second embodiment.
Figure 3B:
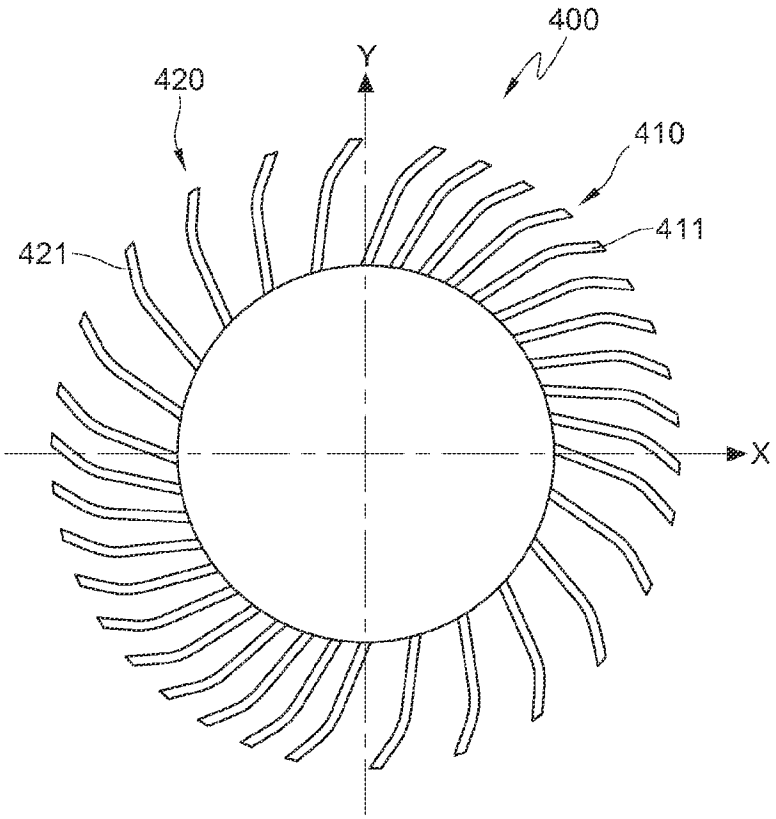
FIG. 3B is a plan view of the hub and a second blade group in FIG. 1.
Figure 3A:
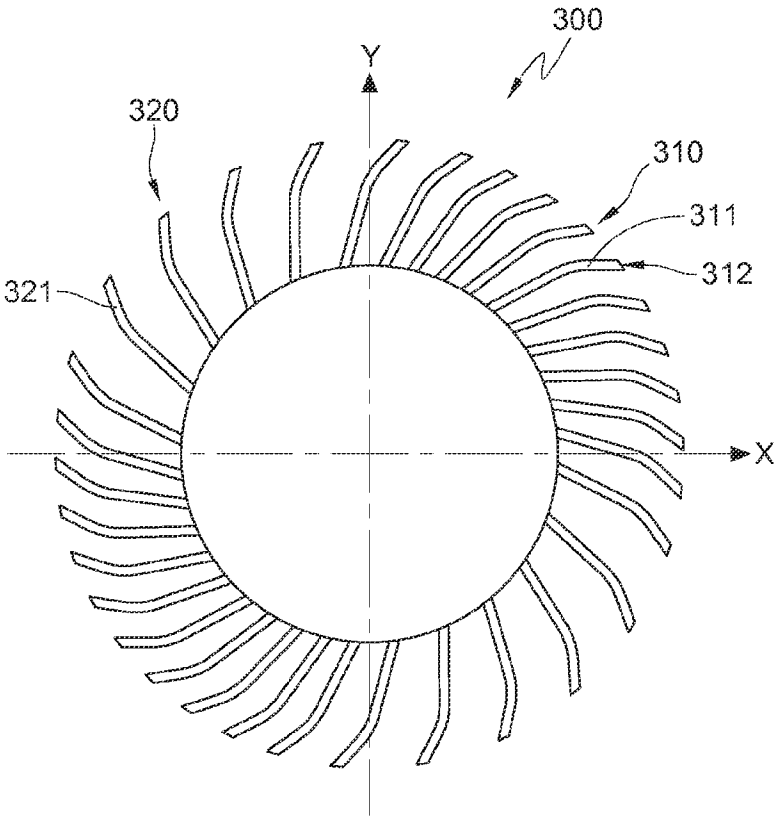
FIG. 3A is a plan view of a hub and a first blade group in FIG. 1.
Figure 4B:
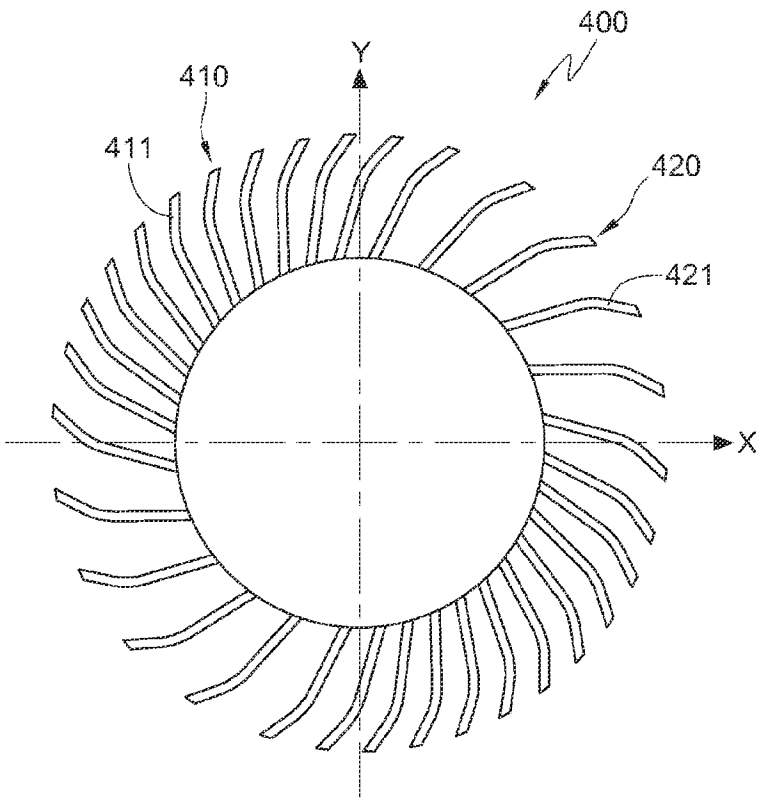
FIG. 4B is a plan view of the hub and the second blade group in the third embodiment.

Please refer to FIG. 1 to FIG. 4B. FIG. 1 is a perspective view of a fan blade structure disclosed in a first embodiment. FIG. 2A is a plan view of FIG. 1. FIG. 2B is an enlarged view of FIG. 2A. FIG. 2C is a plan view of the fan blade structure disclosed in a second embodiment. FIG. 3A is a plan view of a hub and a first blade group in FIG. 1. FIG. 3B is a plan view of the hub and a second blade group in FIG. 1. FIG. 4A is a plan view of the hub and a first blade group in a third embodiment. FIG. 4B is a plan view of the hub and the second blade group in the third embodiment.

A fan blade structure of this embodiment includes a hub 100, an annular partition 200, a first blade group 300 and a second blade group 400. The hub 100 has a top surface 110 and a flank 120. The flank 120 is connected to the top surface 110. The annular partition 200 surrounds the hub 100.

The first blade group 300 is disposed on one side of the annular partition 200, and comprises two first blade arrays 310 and two second blade arrays 320 that are disposed on the flank 120 together. The first blade arrays 310 include a plurality of first blades 311, and the second blade arrays 320 include a plurality of second blades 321. The clearance between the two first blades 311 adjacent to each other is less than that between the two second blades 321 adjacent to each other. In other words, the plurality of first blades 311 are disposed closer than the plurality of second blades 321. Furthermore, each of the plurality of first blades 311 has a free end 312 relatively away from the hub 100. A clearance from the free end 312 to the flank 120 of the hub 100 is d2.

In order to describe the positions of two first blade arrays 310 and two second blade arrays 320, X axis and Y axis are introduced to separate the plane around the hub 100 into four quadrants (as shown in FIG. 3A). Specifically, in this embodiment, the plurality of first blades 311 of two first blade arrays 310 are located in the first and the third quadrants respectively. The second blades 321 of the two second blade arrays 320 are located in the third and the fourth quadrants respectively. In this embodiment, the positions of two first blade arrays 310 and two second blade arrays 320 are only examples for illustration and the disclosure is not limited thereto.

Furthermore, the amount of the first blade arrays 310 and the second blade arrays 320 are two respectively, but the disclosure is not limited thereto. In other embodiments, the quantities of the first blade arrays 310 and the second blade arrays 320 are respectively one. In other embodiments, the first blade arrays 310 are located in the first and the fourth quadrants, and the second blade arrays 320 located in the second and the third quadrants.

The second blade group 400 is disposed on another side of the annular partition 200. That is, the second blade group 400 is disposed at a farther position of the flank 120 than the first blade group 300 relative to the top surface 110. The second blade group 400 comprises a third blade array 410 and a fourth blade array 420. The third blade array 410 and the fourth blade array 420 are disposed on the flank 120 together. The third blade array 410 comprises a plurality of third blades 411, and the fourth blade array 420 comprises a plurality of fourth blades 421. The clearance between the two third blades 411 adjacent to each other is less than that between the two fourth blades 421 adjacent to each other. Moreover, the second blade group 400 and the first blade group 300 are arranged in a staggered form.

In this embodiment and some other embodiments, the annular partition 200 extends from the free end 312 of the first blade 311 towards the hub 100, thus having a difference d1 between the inner diameter and the outer diameter. The difference d1 refers to the clearance from an external wall surface of the annular partition 200 to an internal wall surface of the annular partition 200.

As shown in FIG. 2B, in this embodiment, the angle θ1 formed by extending the plurality of first blades 311 and the plurality of second blades 321 of the first blade group 300 from the flank 120 of hub 100 is equal to the angle θ2 formed by extending the plurality of third blades 411 and the plurality of fourth blades 421 of the second blade group 400 from the flank 120, but the disclosure is not limited thereto. In other embodiments, the angle θ1 formed by extending the plurality of first blades 311 and the plurality of second blades 321 of the first blade group 300 from the flank 120 of hub 100 is different from the angle θ2 formed by extending the plurality of third blades 411 and the plurality of fourth blades 421 of the second blade group 400 from the flank 120. In this embodiment, the first angle θ1 is actually the angle between the extending surface of the plurality of first blades 311 and the tangent planes at joint of the plurality of first blades 311 and hub 100. Similarly, the first angle θ1 is actually the angle between the extending surface of the plurality of second blades 321 and the tangent plane at joint of the plurality of second blades 321 and hub 100. The second angle θ2 is actually the angle between the extending surface of the plurality of third blades 411 and the tangent planes at joint of the plurality of third blades 411 and hub 100. The second angle θ2 is actually the angle between the extending surface of the fourth blade 421 and the tangent plane at joint of the fourth blade 421 and hub 100 (as shown in FIG. 2C).

The relation and positions of the third blade array 410 and fourth blade array 420 of the second blade group 400 are as indicated in the first blade group 300 and thus is not illustrated again herein. The following is only to describe the positional relationship between the first blade group 300 and the second blade group 400. As shown in FIG. 3A and FIG. 3B, in this embodiment, the projection of the first blade array 310 onto the annular partition 200 at least partially overlaps the projection of the third blade array 410 onto the annular partition 200. The projection of the second blade array 320 onto the annular partition 200 at least partially overlaps the projection of the fourth blade array 420 onto the annular partition 200. That is, the two first blade arrays 310, arranged closely, of the first blade group 300 are respectively located in the first quadrant and third quadrant, while two second blade arrays 320, arranged less closely than the two first blade arrays 310, are respectively located in the second quadrant and the fourth quadrant. Similarly, the two third blade arrays 410 of the second blade group 400, arranged closely, are respectively located in the first and third quadrants, while the two fourth blade arrays 420, arranged less closely than the two third blade arrays 410, are respectively located in the second quadrant and the fourth quadrant. In this embodiment, the difference d1 of the annular partition 200 is greater than one third of the clearance d2 from the free end 312 of the first blade 311 to the flank 120 of the hub 100 (as shown in FIG. 2A).

Figure 4A:
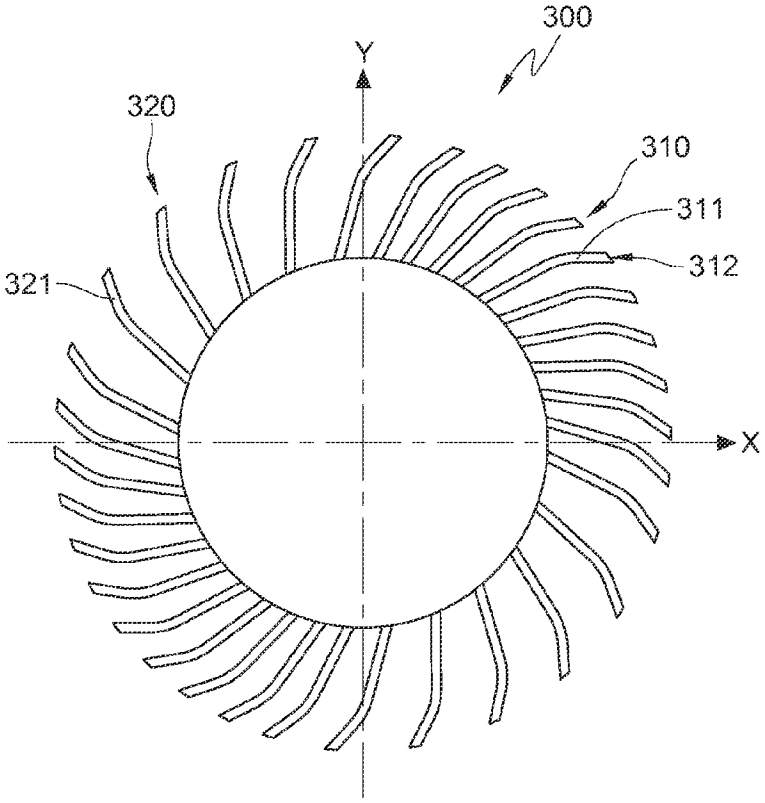
FIG. 4A is a plan view of the hub and a first blade group in a third embodiment.

However, in other embodiments, the arrangement mode for the first to fourth blade arrays 310, 320, 410 and 420 are not limited the foregoing embodiment. As shown in FIG. 4A and FIG. 4B, the projection of the first blade array 310 of this embodiment onto the annular partition 200 at least partially overlaps the projection of the fourth blade array 420 onto the annular partition 200. The projection of the second blade array 320 onto the annular partition 200 at least partially overlaps the projection of the third blade array 410 onto the annular partition 200. That is to say, the two first blade arrays 310 of the first blade group 300, arranged closely, are respectively located in the first quadrant and the third quadrant, while the two second blade arrays 320, arranged less closely than the two first blade arrays 310, are respectively located in the second quadrant and the fourth quadrant. The two third blade arrays 410 of the second blade group 400, arranged closely, are respectively located in the second quadrant and the fourth quadrant, while two fourth blade arrays 420, arranged less closely than the two third blade arrays 410, are respectively located in the first and third quadrants. In other words, in this embodiment, arrangement of the first blade group 300 and the second blade group 400 is in a vertically staggered relationship. Moreover, the internal and outer diameter difference of the annular partition 200 is about less than one half of the clearance from the free ends 312 of the plurality of first blades 311 to the hub 100.

The annular partition 200 of this embodiment is capable of separating the air flow field of the first blade group 300 from that of the second blade group 400. Thus, a mutual interference between the upper-side air flow and lower-side air flow of the annular partition 200 does not occur causing air leakage or turbulence. Thereby, the operating noise for the heat dissipation device 100 provided with this fan blade structure is reduced. Moreover, the plurality of first blades 311 and the plurality of second blades 321 are in a staggered arrangement with the plurality of third blades 411 and the plurality of fourth blades 421 respectively. Thereby, a time difference between the plurality of first blades 311 and the plurality of second blades 321, and the plurality of third blades 411 and the plurality of fourth blades 421 is formed respectively. Thus, audio frequency generated when the fan blade structure 10 operates is decreased, so as to reduce the operating noise (sound quality) for the heat dissipation device 100 provided with this fan blade structure.

Figure 5:
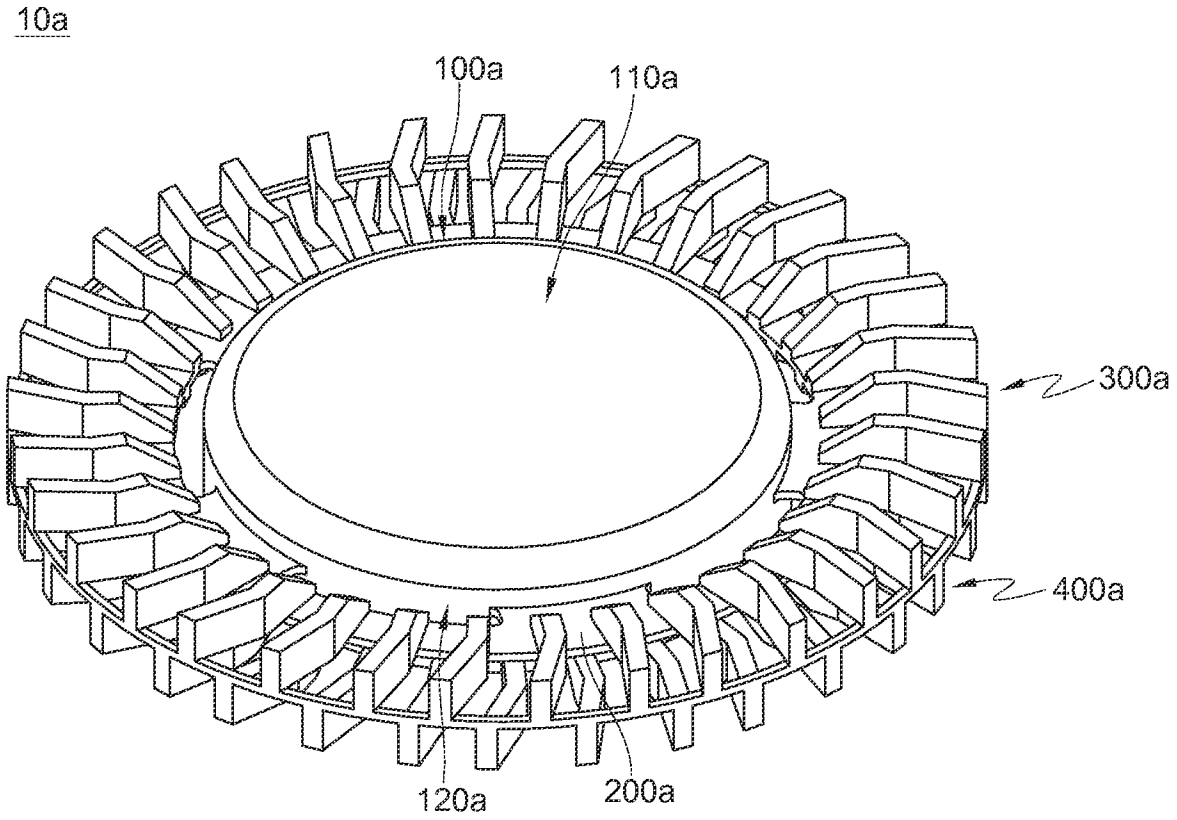
FIG. 5 is a perspective view of the fan blade structure disclosed in a fourth embodiment.
Figure 6:
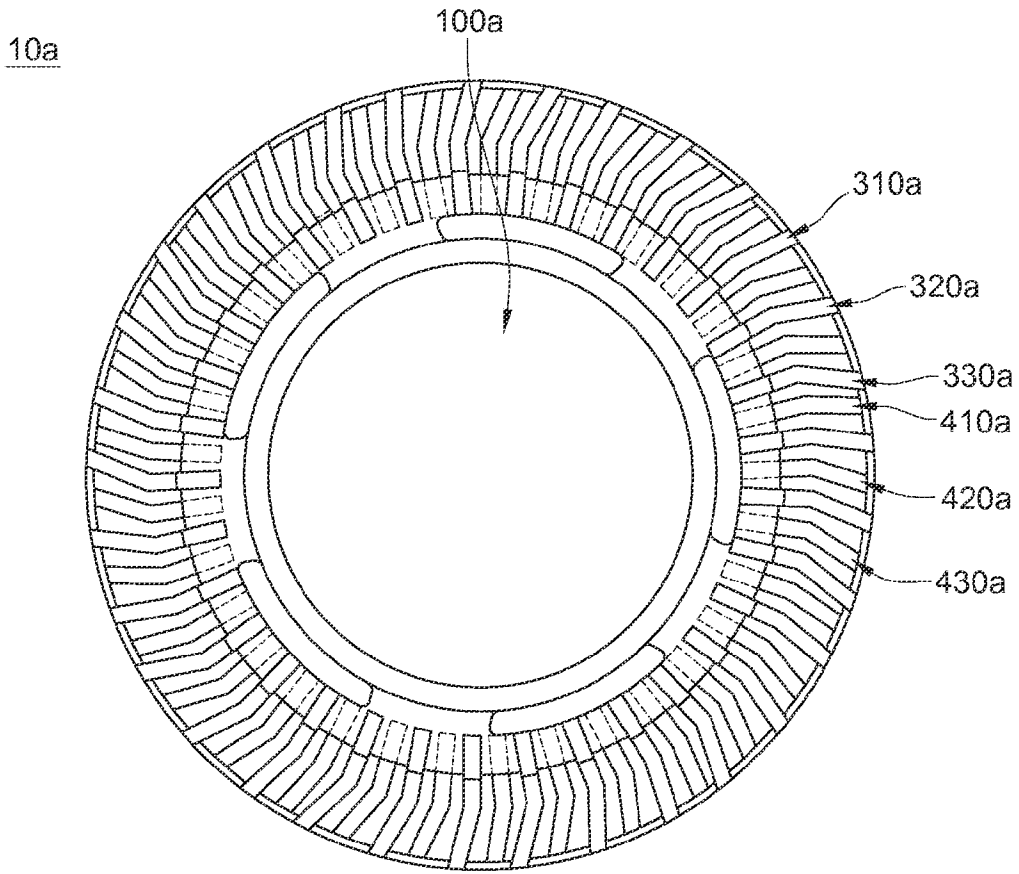
FIG. 6 is a plan view of FIG. 5.
Figure 7:
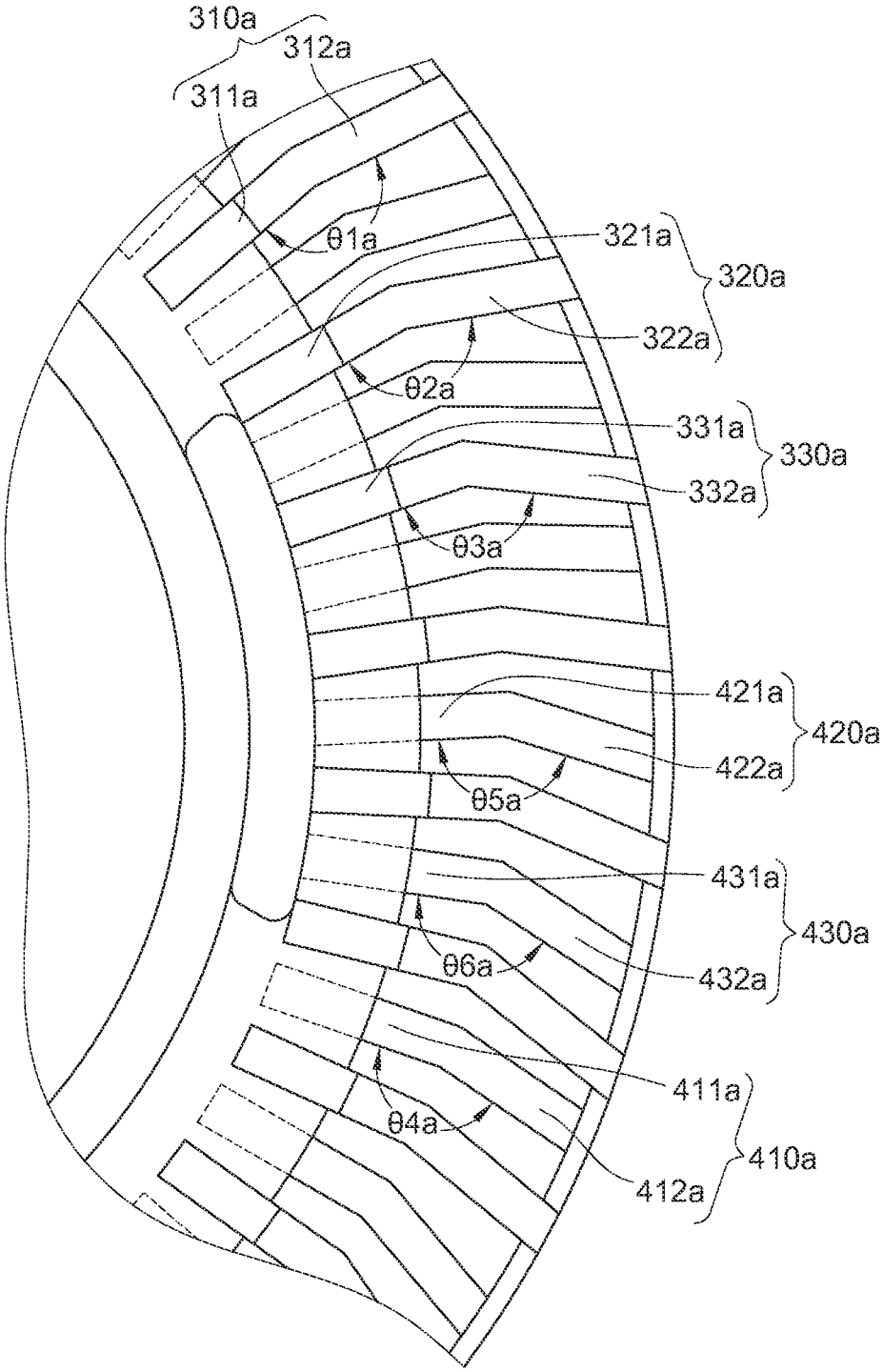
FIG. 7 is an enlarged view of FIG. 6.

Please refer to FIG. 5 to FIG. 7. FIG. 5 is a perspective view of the fan blade structure disclosed in fourth embodiment. FIG. 6 is a plan view of FIG. 5. FIG. 7 is an enlarged view of FIG. 6.

In this embodiment, a fan blade structure 10*a* includes a hub 100*a*, an annular partition 200*a*, a first blade group 300*a* and a second blade group 400*a*.

The hub 100*a* has a top surface 110*a* and a flank 120*a* connected to the top surface 110*a*. The annular partition 200*a* is disposed on the flank 120*a*.

The first blade group 300*a* is disposed on one side of the annular partition 200*a*, and comprises a plurality of first blades 310*a*, a plurality of two second blades 320*a* and a plurality of two third blades 330*a*. The plurality of first blades 310*a*, the plurality of second blades 320*a* and the plurality of third blades 330*a* are arranged in a first order, and altogether surround the hub 100*a*. The plurality of first blades 310*a*, the plurality of second blades 320*a* and the plurality of third blades 330*a* respectively have a connection segment, 311*a*, 321*a*, 331*a*, and a free end 312*a*, 322*a*, 332*a*. The connection segments 311*a*, 321*a* and 331*a* are connected to the annular partition 200*a* respectively. The connection segment 311*a* and the free end 312*a* of each of the plurality of first blades 310*a* form a first angle θ1a. The connection segment 321*a* and the free end 322*a* of each second blade 320*a* form a second angle θ2a. The connection segment 331*a* and the free end 332*a* of each plurality of the third blades 330*a* form a third angle θ3a. The angles θ1a, θ2a and θ3a are different from each other.

The second blade group 400*a* is disposed on another side of the annular partition 200*a*, and comprises a plurality of fourth blades 410*a*, a plurality of fifth blades 420*a* and a plurality of sixth blades 430*a*. The plurality of fourth blades 410*a*, the plurality of fifth blades 420*a* and the plurality of sixth blades 430*a* are arranged in a second order, and altogether surround the hub 100*a*. The plurality of fourth blades 410*a*, the plurality of fifth blades 420*a* and the plurality of sixth blades 430*a* respectively have a connection segment 411*a*, 421*a*, 431*a*, and a free end 412*a*, 422*a*, 423*a*. The connection segments 411*a*, 421*a*, 431*a* are connected to the annular partition 200*a* respectively. The connection segment 411*a* and the free end 412*a* of each of the plurality of fourth blades 410*a* form a fourth angle θ4a. The connection segment 421*a* and the free end 422*a* of each of the plurality of fifth blades 420*a* form a fifth angle θ5a. The connection segment 431*a* and the free end 432*a* of each of the plurality of third blade 430*a* form a third angle θ6a. The angles θ4a, θ5a and θ6a are different from each other.

In this embodiment and some other embodiments, the clearances among the connection segments 311*a*, 321*a* and 331*a* of the plurality of first blades 310*a*, the plurality of second blades 320*a* and the plurality of third blades 330*a* are equal. The clearances among the connection segments 411*a*, 421*a* and 431*a* of the plurality of fourth blades 410*a*, the plurality of fifth blades 420*a* and the plurality of sixth blades 430*a* are equal.

In this embodiment and other embodiments, the first angle θ1a is greater than the second angle θ2a and the second angle θ2a is greater than the third angle θ3a. The fourth angle θ4*a* is greater than the fifth angle θ5a and the fifth angle θ5a is greater than the sixth angle θ6a. Also, the first angle θ1a is equal to the fourth angle θ4a. The second angle θ2a is equal to the fifth angle θ5a. The third angle θ3a is equal to the sixth angle θ6a. The projection positions of the plurality of first blades 310*a* and the plurality of sixth blades 430*a* in the same plane are adjacent. The projection positions of the plurality of second blades 320*a* and the plurality of fifth blades 420*a* in the same plane are adjacent. The projection positions of the plurality of third blades 330*a* and the plurality of fourth blades 410*a* in the same plane are adjacent.

The plurality of first blades 310*a*, the plurality of second blades 320*a*, the plurality of third blades 330*a*, the plurality of fourth blades 410*a*, the plurality of fifth blades 420*a* and the plurality of sixth blades 430*a* are all arranged in order respectively. For example, the plurality of first blades 310*a*, the plurality of second blades 320*a* and the plurality of third blades 330*a* may be arranged in following order: a first blade 310*a*, a second blade 320*a* and a third blade 330*a*; while the plurality of fourth blades 410*a*, the plurality of fifth blades 420*a* and the plurality of sixth blades 430*a* may be arranged in following order: a sixth blade 430*a*, a fifth blade 420*a* and a fourth blade 410*a*, but not limited thereto. In other embodiments, the plurality of first blades 310*a*, the plurality of second blades 320*a* and the plurality of third blades 330*a* may be arranged in following order: a first blade 310*a*, a second blade 320*a*, a third blade 330*a*, a second blade 320*a*, a first blade 310*a*, a second blade 320*a*, a third blade 330*a* and a third blade 330*a*. The plurality of fourth blades 410*a*, the plurality of fifth blades 420*a* and the plurality of sixth blades 430*a* may be accordingly arranged in following order: a sixth blade 430*a*, a fifth blade 420*a*, a fourth blade 410*a*, a fifth blade 420*a*, a sixth blade 430*a*, a fifth blade 420*a*, a fourth blade 410*a* and a fourth blade 410*a*.

The projection positions of the plurality of first blades 310*a* and the plurality of sixth blades 430*a* in the same plane are adjacent indicates that the plurality of sixth blades 430*a* may be upright below the plurality of first blades 310*a*, or staggered between each other with a horizontal offset. Also, the relation between the second blade 320*a* and the plurality of fifth blades 420*a*, and the third blade 330*a* and the plurality of fourth blades 410*a* are arranged in a similar way, and thus are not illustrated herein.

In this embodiment, the first blade group 300*a* and the second blade group 400*a* of the fan blade structure are asymmetrically distributed. Therefore, the acoustic energy generated during the operation of the fan blade structure 10*a* is dispersed. Thereby, the operating noise for the heat dissipation device provided with this fan blade structure is reduced.

Figure 8:
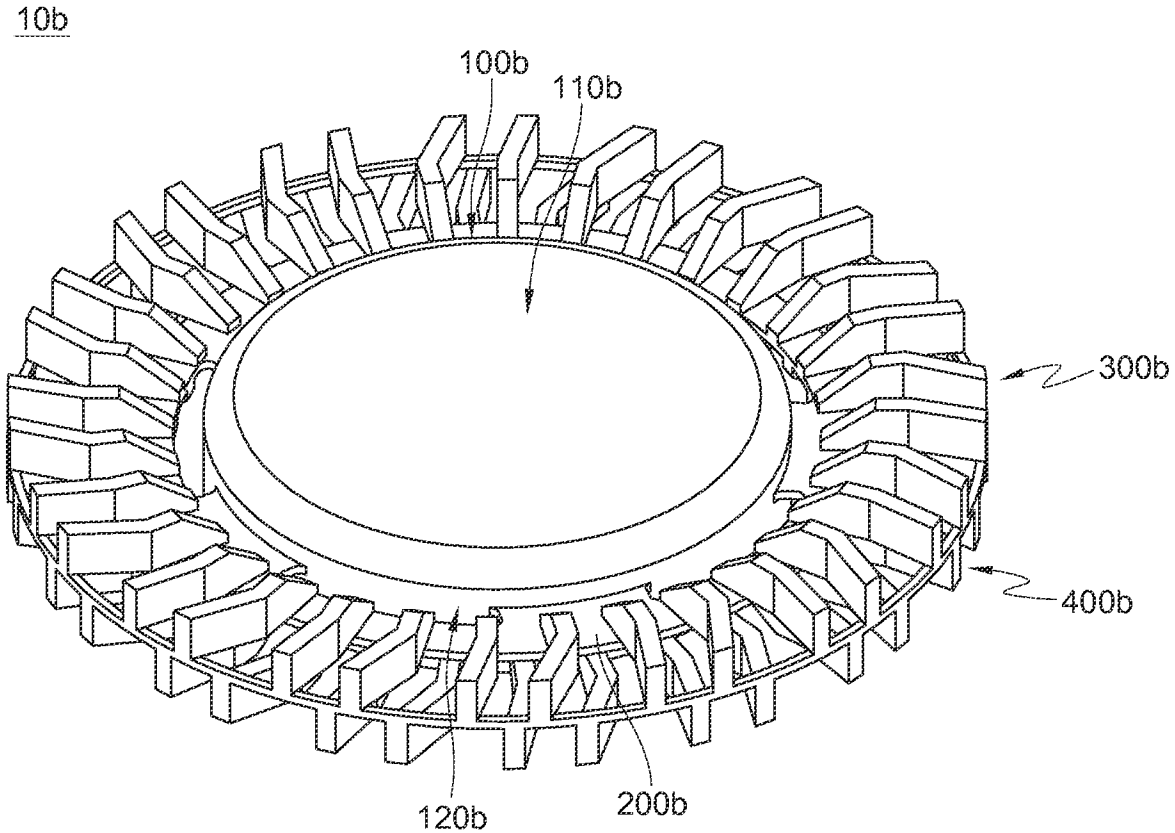
FIG. 8 is a perspective view of the fan blade structure disclosed a fifth embodiment.
Figure 9:
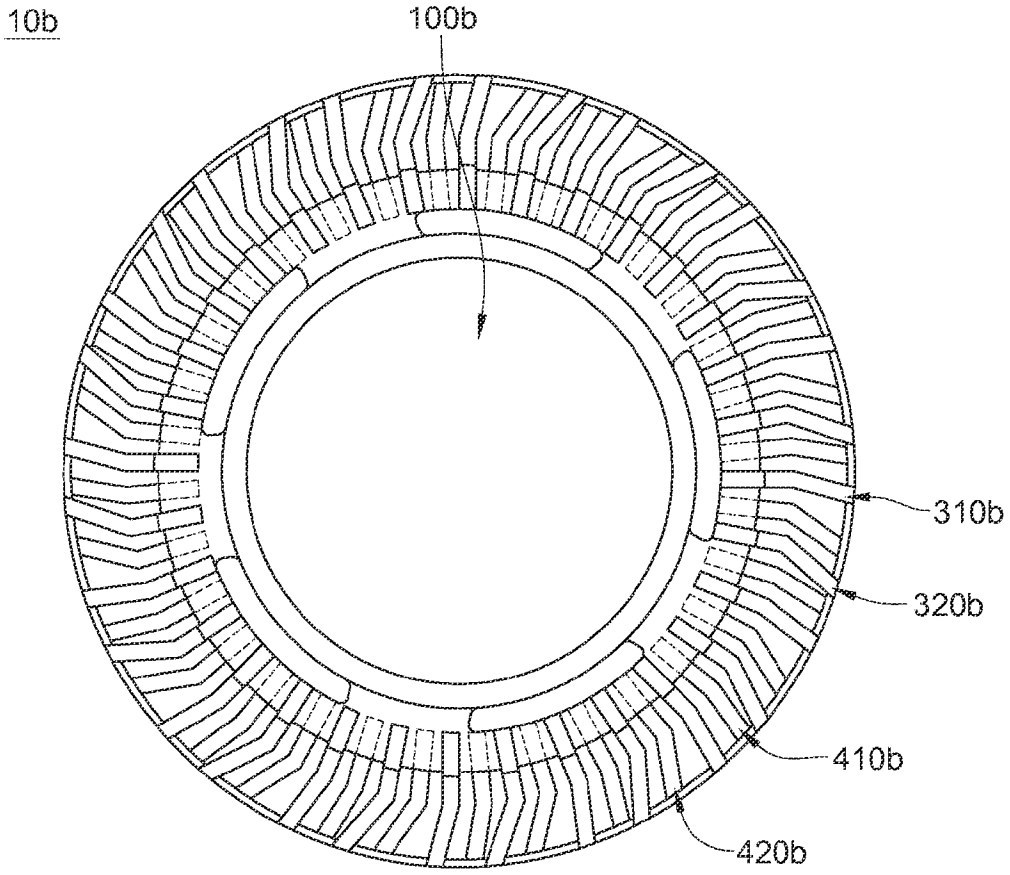
FIG. 9 is a plan view of FIG. 8.
Figure 10:
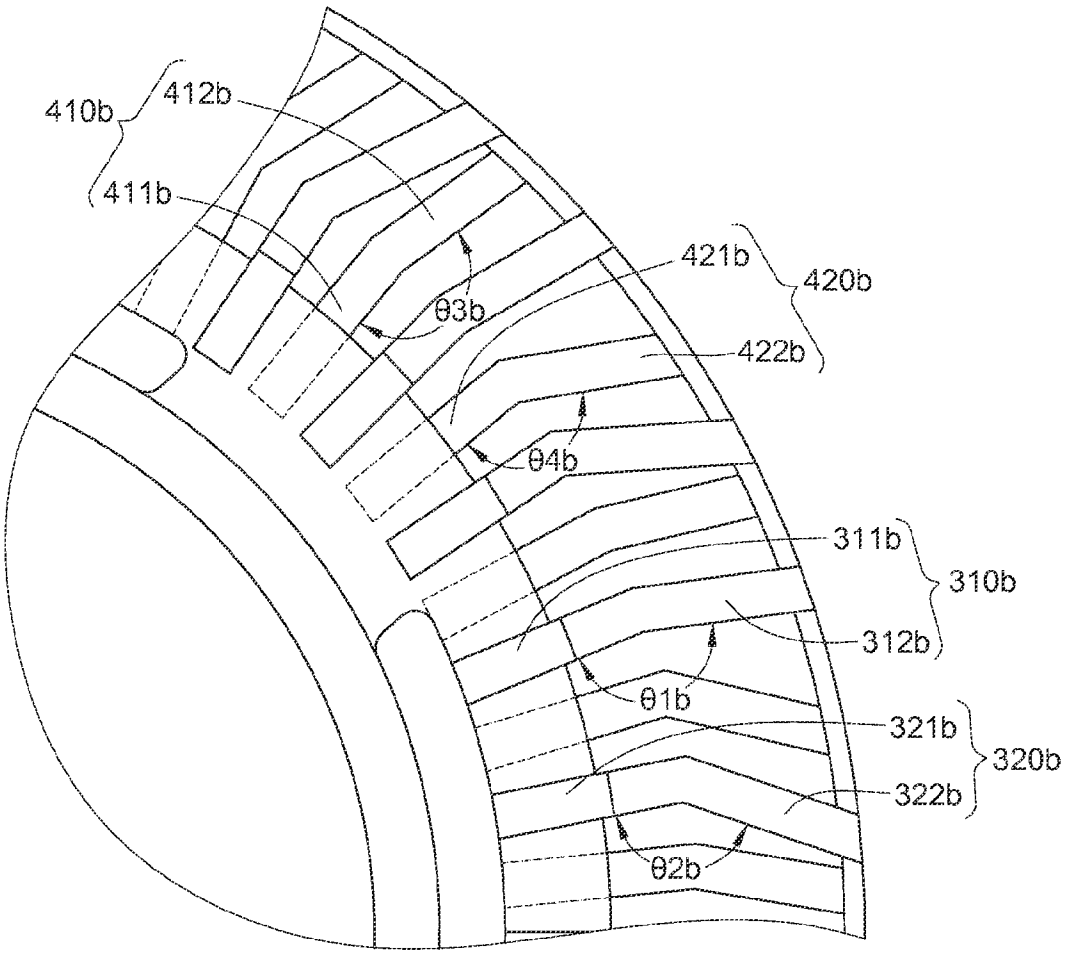
FIG. 10 is an enlarged view of FIG. 9.

Each of the above-mentioned first blade group 300*a* and the second blade group 400*a* comprises a plurality of blades having three different angles, but not limited thereto. In other embodiments, the first blade group 300*a* and the second blade group 400*a* respectively comprise a plurality of blades having two different angles or blades having four or more different angles. Please refer to FIG. 8 to FIG. 10. FIG. 8 is a perspective view of the fan blade structure disclosed in fifth embodiment. FIG. 9 is a plan view of FIG. 8. FIG. 10 is an enlarged view of FIG. 9.

In this embodiment, the fan blade structure 10*b* includes a hub 100*b*, an annular partition 200*b*, a first blade group 300*b* and a second blade group 400*b*. The hub 100*b* has a top surface 110*b* and a flank 120*b* connected to the top surface 110*b*. The annular partition 200*b* is disposed on the flank 120*b*.

The first blade group 300*b* is disposed on the same side of the annular partition 200*b*, and comprises a plurality of first blades 310*b* and a plurality of second blades 320*b*. The plurality of first blades 310*b* and the plurality of second blades 320*b* are in staggered arrangement, and altogether surround the hub 100*b*. The plurality of first blades 310*b* and the plurality of second blades 320*b* respectively have a connection segment 311*b*, 321*b*, and a free end 321*b*, 322*b*. The connection segments 311*b* and 321*b* are respectively connected to the annular partition 200*b*. The connection segment 311*b* and the free end 31*b* of each of the plurality of first blade 310*b* form a first angle θ1b. The connection segment 321*b* and the free end 322*b* of each of the plurality of second blade 320*b* form a second angle θ2a. The second angle θ2a is different from the first angle θ1b.

The second blade group 400*b* is disposed on the same side of the annular partition 200*b*. The annular partition 200*b* is located between the first fan blade group 300*b* and the second fan blade group 400*b*. The second blade group 400*b* comprises a plurality of third blades 410*b* and a plurality of fourth blades 420*b*. The plurality of third blades 410*b* and the plurality of fourth blades 420*b* are in the staggered arrangement, and altogether surround the hub 100*b*. The plurality of third blades 410*b* and the plurality of fourth blades 420*b* respectively have a connection segment 411*b*, 421*b*, and a free end 421*b*, 422*b*. The connection segments 411*b* and 421*b* are respectively connected to the annular partition 200*b*. The connection segment 411*b* and the free end 412*b* of each of the plurality of third blade 410*b* form a third angle θ3b. The connection segment 421*b* and the free end 422*b* of each of the plurality of second blade 420*b* form a fourth angle θ4a. The fourth angle θ4a is different from the third angle θ3b.

In this embodiment and other embodiments, the clearances among the connection segments 311*b*, 321*b* of the plurality of first blades 310*b* and the plurality of second blades 320*b* are equal. The clearances among the connection segments 411*b*, 421*b* of the plurality of third blades 410*b* and the plurality of fourth blades 420*b* are equal.

In this embodiment and some other embodiments, the first angle θ1b is greater than the second angle θ2. The third angle θ3b is greater than the fourth angle θ4b. Furthermore, the first angle θ1b is equal to the third angle θ3b. The second angle θ2b is equal to the fourth angle θ4a. The projection positions of the plurality of first blades 310*b* and the plurality of fourth blades 420*b* in the same plane are adjacent. The projection positions of the plurality of second blades 320*b* and the plurality of third blades 410*b* in the same plane are adjacent.

According to the fan blade structure disclosed in above-mentioned embodiments, the annular partition is disposed between the first blade group and the second blade group. Thereby the air flow fields of the first blade group and the second blade group is separated. Thus, a mutual interference between the upper-side air flow and lower-side air flow of the annular partition does not occur causing air leakage or turbulence. Therefore, the operating noise for the heat dissipation device provided with this fan blade structure is reduced.

Moreover, the plurality of first blades and the plurality of second blades are in staggered arrangement with the plurality of third blades and the plurality of fourth blades to form a time difference between the first plurality of blades and the plurality of second blades, and the plurality of third blades and the plurality of fourth blades, respectively. Thus audio frequency generated when the fan blade structure operates is decreased. Thereby, the operating noise for the heat dissipation device provided with this fan blade structure is reduced.

Moreover, the first blade group and second blade group have an asymmetric angular distribution to disperse the acoustic energy generated during the operation of fan blade structure. Thereby, the operating noise for the heat dissipation device provided with this fan blade structure is reduced.

What is claimed is:

1. A fan blade structure, comprising:

a hub having a top surface and a flank connected to the top surface;

an annular partition surrounding the hub;

a first blade group disposed on one side of the annular partition, the first blade group comprising a first blade array and a second blade array, the first blade array comprising a plurality of first blades, the second blade array comprising a plurality of second blades, and the clearance between the two first blades adjacent to each other being less than that between the two second blades adjacent to each other; and a second blade group disposed on another side of the annular partition, the second blade group comprising a third blade array and a fourth blade array, the third blade array comprising a plurality of third blades, the fourth blade array comprising a plurality of fourth blades, and the clearance between the two third blades adjacent to each other being less than that between the two fourth blades adjacent to each other, wherein each of the plurality of first blades has a free end relatively away from the hub, and the annular partition extends from the free end towards the hub; and wherein the projection of the first blade array onto the annular partition at least partially overlaps the projection of the fourth blade array onto the annular partition, and the projection of the second blade array onto the annular partition at least partially overlaps the projection of the third blade array onto the annular partition.

2. The fan blade structure of claim 1, wherein the projection of the first blade array onto the annular partition at least partially overlaps the projection of the third blade array onto the annular partition, and the projection of the second blade array onto the annular partition at least partially overlaps the projection of the fourth blade array onto the annular partition.

3. The fan blade structure of claim 1, wherein a difference between an inner diameter and an outer diameter of the annular partition is greater than one third of the clearance from the free end of the first blade to the hub.

4. The fan blade structure of claim 1, wherein a difference between an inner diameter and an outer diameter of the annular partition is less than one half of the clearance from the free ends of the plurality of first blades to the hub.

5. A fan blade structure, comprising:

a hub, having a top surface and a flank connected to the top surface;

an annular partition disposed on the flank;

a first blade group disposed on one side of the annular partition, the first blade group comprising a first blade array and a second blade array, the first blade array comprising a plurality of first blades, the second blade array comprising a plurality of second blades, the plurality of first blades and the plurality of second blades being arranged in a staggered form, each of the plurality of first blades and the plurality of second blades having a connection segment and a free segment connected to each other, the connection segments of the plurality of first blades and the connection segments of the plurality of second blades being connected to the annular partition respectively, the connection segment and the free segment of each of the plurality of first blades forming a first angle, and the connection segment and the free segment of each of the plurality of second blades forming a second angle, wherein the second angle is different from the first angle; and a second blade group disposed on another side of the annular partition, the second blade group comprising a third blade array and a fourth blade array, the third blade array comprising a plurality of third blades, the fourth blade array comprising a plurality of fourth blades, the plurality of third blades and the plurality of fourth blades being arranged in a staggered form, each of the plurality of third blades and plurality of fourth blades respectively having a connection segment and a free segment connected, the connection segments being respectively connected to the annular partition, the connection segment and the free segment of each of the plurality of third blades forming a third angle, and the connection segment and the free segment of each of the plurality of fourth blades forming a fourth angle, wherein the forth angle is different from the third angle, wherein the free segment of each of the plurality of first blades is relatively away from the hub, and the annular partition extends from the free segment towards the hub; and wherein the projection of the first blade array onto the annular partition at least partially overlaps the projection of the fourth blade array onto the annular partition, and the projection of the second blade array onto the annular partition at least partially overlaps the projection of the third blade array onto the annular partition.

6. The fan blade structure of claim 5, wherein the first angle is greater than the second angle, the third angle is greater than the fourth angle, the first angle is equal to the third angle, the second angle is equal to the fourth angle, projection positions of the plurality of first blades and those of the plurality of fourth blades in the same plane are adjacent, and projection positions of the plurality of second blades and those of the plurality of third blades in the same plane are adjacent.

7. A fan blade structure, comprising:

a hub, having a top surface and a flank connected to the top surface;

an annular partition disposed on the flank;

a first blade group disposed on one side of the annular partition, the first blade group comprising a plurality of first blades, a plurality of second blades and a plurality of third blades, wherein the plurality of first blades, the plurality of second blades and the plurality of third blades are arranged in a first order; each of the plurality of first blades, the plurality of second blades and the plurality of third blades has a connection segment and a free segment connected, the connection segments of the plurality of first blades, the plurality of second blades and the plurality of third blades are connected to the annular partition respectively, the connection segment and the free segment of each of the plurality of first blades form a first angle, the connection segment and the free segment of each of the plurality of second blades form a second angle, and the connection segment and the free segment of each of the plurality of third blade form a third angle, and the first angle, the second angle and the third angle are different from each other; and a second blade group disposed on another side of the annular partition, the second blade group comprising a plurality of fourth blades, a plurality of fifth blades and a plurality of sixth blades, the plurality of fourth blades, the plurality of fifth blades and the plurality of sixth blades being arranged in a second order, the plurality of fourth blades, the plurality of fifth blades and the plurality of sixth blades respectively having a connection segment and a free segment connected to each other, and the connection segments of the plurality of fourth blades, the plurality of fifth blades and the plurality of sixth blades being connected to the annular partition respectively, the connection segment and the free segment of each of the plurality of fourth blades forming a fourth angle, the connection segment and the free segment of each of the plurality of fifth blades forming a fifth angle, and the connection segment and the free segment of each of the plurality of sixth blades forming a sixth angle, wherein the fourth angle, fifth angle and sixth angle are different from each other, wherein the free segment of each of the plurality of first blades is relatively away from the hub, and the annular partition extends from the free segment towards the hub.

8. The fan blade structure of claim 7, wherein clearances among the connection segments of the plurality of first blades, the plurality of second blades and the plurality of third blades are equal, and clearances among the connection segments of the plurality of fourth blades, the plurality of fifth blades and the plurality of sixth blades are equal.

9. The fan blade structure of claim 7, wherein the first angle is greater than the second angle, the second angle is greater than the third angle, the fourth angle is greater than the fifth angle, the fifth angle is greater than the sixth angle, the first angle is equal to the fourth angle, the second angle is equal to the fifth angle, and the third angle is equal to the sixth angle, projection positions of the plurality of first blades and the plurality of sixth blades in the same plane are adjacent, projection positions of the plurality of second blades and the plurality of fifth blades in the same plane are adjacent, and projection positions of the plurality of third blades and the plurality of fourth blades in the same plane are adjacent.

* * * * *